United States Patent [19]

Hutchison

[11] Patent Number: 4,829,740

[45] Date of Patent: May 16, 1989

[54] APPARATUS FOR JOINING WALL PANELS

[75] Inventor: Douglas Hutchison, St. Charles, Mo.

[73] Assignee: Dunmon Corporation, St. Louis, Mo.

[21] Appl. No.: 110,174

[22] Filed: Oct. 19, 1987

[51] Int. Cl.[4] ..... E04B 2/00

[52] U.S. Cl. ..... 52/762; 52/772; 52/509

[58] Field of Search ..... 52/235, 280, 281, 283, 52/361, 363, 385, 401, 417, 461, 463, 465, 466, 468, 471, 481, 483, 489, 509, 512, 714, 715, 762, 766, 781, 582, 586, 464, 771, 772, 774, 775, 780, 510

[56] References Cited

U.S. PATENT DOCUMENTS

| | | | |
|---|---|---|---|
| 2,532,011 | 11/1950 | Dahlquist et al. | 52/417 X |
| 2,735,523 | 2/1956 | Leyerle et al. | 52/509 |
| 3,667,182 | 6/1972 | Stemler | 52/497 |
| 3,832,820 | 9/1974 | Eggert | 52/762 |
| 4,344,267 | 8/1982 | Sukolics | 52/762 |
| 4,452,029 | 6/1984 | Sukolics | 52/747 |
| 4,598,516 | 7/1986 | Groshong | 52/241 |

FOREIGN PATENT DOCUMENTS 1381143 2/1964 France .

*Primary Examiner*—Henry E. Raduazo
*Assistant Examiner*—Creighton Smith
*Attorney, Agent, or Firm*—Bachman & LaPointe

[57] ABSTRACT

An apparatus for joining panel members into walls or dividers is provided which does not require the use of a wet sealant to close the gap between adjacent panels and which allows thermal expansion and/or contraction of the panel members to be absorbed by the joints. The apparatus includes a channel for receiving turned down edges of adjacent panel members. The channel has interlocking portions for engaging mating portions on the panel edges and locking them into position. A resilient spring member is used to hold the interlocking and mating portions in engagement. A profiled elastomeric sealing member is provided to seal the gap between the panel members. The sealing member is held in position by the resilient spring member.

14 Claims, 1 Drawing Sheet

APPARATUS FOR JOINING WALL PANELS

CROSS-REFERENCE TO RELATED APPLICATION

The present application is related to commonly assigned, co-pending application Ser. No. 110,421, filed Oct. 20, 1987.

BACKGROUND OF THE INVENTION

The present invention relates to an apparatus for securing or joining metal panel members to building structures for forming walls and dividers. More particularly, the invention relates to constructions which eliminate the need for certain sealants between wall panel members and which allow thermal expansion of the wall panel members to be absorbed by the connecting apparatus without causing warping or distortion of the wall panel members.

Walls have been constructed in the past using panels with wedges for securely trapping and holding the edges of panel members in place. French Pat. No. 1,381,143 to Kentzler illustrates one such system. In many of these prior panel attaching systems, the edges of the panel members are securely locked into position in such a manner that thermal expansion of the panel members produces warping or other distortion in the panel members.

U.S. Pat. No. 3,667,182 to Stemler illustrates one panel attaching device in which a flexible strip of rubber, plastic or other resilient material is used to hold two adjacent panels in position within a channel. In this way, the panels are allowed a certain degree of lateral movement relative to the framing as they expand, contract, or are subjected to changes in load thereon. U.S. Pat. No. 3,832,820 to Eggert illustrates a similar panel mounting device in which a channel has edges formed in the shape of a hook, panels to be positioned within the channel have a corresponding hook shaped portion, and a strip of resilient material having a circular cross section is wedged in the channel to hold the hooks in interlocking relation.

U.S. Pat. Nos. 4,344,267 and 4,452,029, both to Sukolics, illustrate a panel securing apparatus which allows for thermal expansion of the panel members. The apparatus comprises a channel member having sidewalls with integral semi-cylindrical locking portions adapted to engage similarly shaped portions on the edges of panels to be positioned within the channel. To hold and lock the panel edges within the channel, a rigid member having protrusions is inserted between the panel members.

Many of these panel securing systems are known as wet set systems because of their use of sealants such as silicone sealants to seal the gaps in exterior walls. In these systems, the sealant when exposed to the atmosphere, in some environments, collects dirt and allows it to spread across the panel faces rendering them aesthetically unappealing. To overcome this problem, it has been proposed to replace the "wet" sealant exposed to the atmosphere by a dry sealant.

Accordingly, it is an object of the present invention to provide a panel securing apparatus which does not require the use of a wet sealant to close the gap between adjacent panels forming an exterior wall.

It is a further object of the present invention to provide a panel securing apparatus as above which also allows for thermal expansion and/or contraction of adjoining panel members.

It is yet another object of the present invention to provide a panel securing apparatus as above which permits the panel members to retain an aesthetically pleasing appearance.

These and other objects and advantages will become more apparent from the following description and drawings in which like reference numerals depict like elements.

SUMMARY OF THE INVENTION

In accordance with the present invention, the apparatus for joining adjacent panel members together comprises a substantially U-shaped channel having a base portion and a pair of sidewalls with each sidewall having a substantially semi-cylindrical locking portion adapted to engage a similarly shaped mating portion on an edge of a panel positioned within the channel. The apparatus further includes a resilient member inserted between the edges of adjacent panel members to maintain the sidewall locking portions and mating edge portions in engagement with each other and to allow pivotal movement of the panel edges positioned within the channel, and means for sealing the gap between adjacent panel members. In a preferred embodiment, the sealing means comprises a profiled elastomeric member having locking surfaces and the resilient member comprises a stainless steel spring having a base portion, sidewall segments with arcuate edge portions forming a hollow interior portion for receiving the profiled member and for engaging the locking surfaces, and angled segments joining the base portion to the sidewall segments.

DETAILED DESCRIPTION

Figure 1:
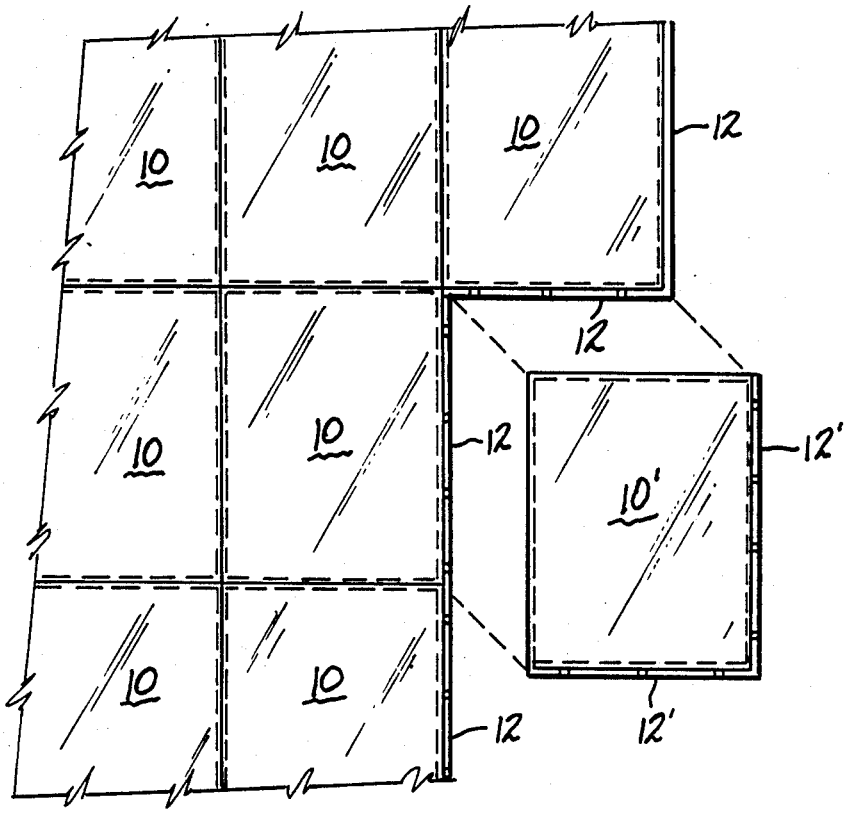
FIG. 1 is a perspective view illustrating a portion of a wall made up of a plurality of joined panel members.

FIG. 1 shows a wall composed of several panel members 10 which are held together by channel members 12 as described below. Panel members 10 may be any metal, plastic or composite panel which may be formed and machined as shown.

Channel members 12 are secured to a building structure by suitable fastening means such as screws. If desired, members 12 may be previously laid out in a grid type fashion. In the embodiment shown in FIG. 1, channel members 12' are loosely attached to two of the four edges of panel member 10'. The two edges of panel member 10' not having channels 12' attached may be inserted into matching channels 12 already secured to the building structure. After the panel members 10' have been positioned, channel members 12' may be secured to the building structure. This method alleviates the need to accurately locate and secure a grid to the building structure before assembling panel members 10 into a wall.

Figure 2:
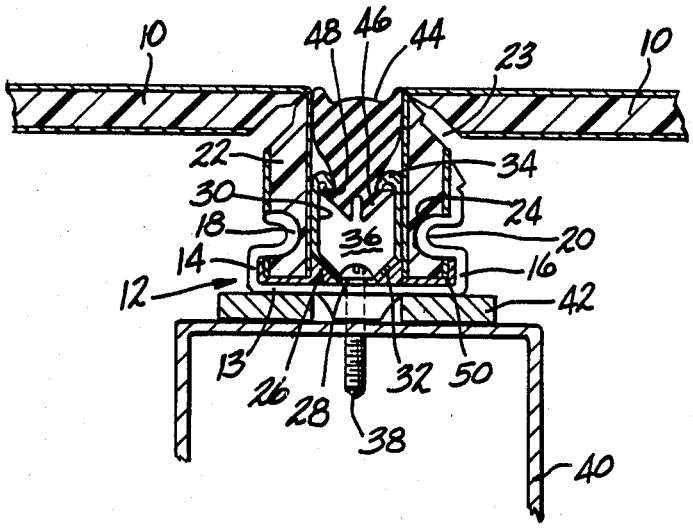
FIG. 2 is a cross-sectional view of a panel joining apparatus in accordance with the present invention.

FIG. 2 shows the construction of a preferred embodiment of the present invention. Channel member 12 has a substantially U-shaped configuration with a base portion 13, a short side 14 and a long side 16. Short side 14 has a panel interlock 18 on its inner side in the form of a ridge running longitudinally along the length of the side. A panel interlock 20 is also formed on the inner side of the long side 16 also in the form of a ridge running longitudinally along the length of the side. The interlocks 18 and 20 each preferably have a substantially semi-cylindrical shape. Channel member 12 may be made of any suitable material known in the art including but not limited to metals such as aluminum or an aluminum alloy.

Edges 22 of side by side, spaced apart panel members 10 are turned down such that they may be inserted into channel member 12. Grooves 24, also preferably having a substantially semi-cylindrical configuration, are provided longitudinally along the inner sides of turned down edges 22. The grooves 24 are sized to accept interlocks 18 and 20 of sides 14 and 16 of channel 12.

The edges 22 of the panel members 10 are sized such that there is a slight space between the ends of the edges 22 and the base portion 13 of channel member 12. By sizing the edges in this way, the panel members can accommodate rotation of the edges around interlocks 18 and 20 when subjected to thermal expansion or contraction. The rotation action is further enhanced by providing reduce areas 23 at the inner corner where panel members 10 join turned down edges 22. Area 23 may be provided by machining or stamping with an appropriate die as panel members 10 are being formed.

A resilient or spring-like member 26 is positioned between the turned down edges 22 in the channel to maintain the grooves 24 in cooperation with interlocks 18 and 20 and to lock the panel members 10 into position relative to the channel 12. Member 26 preferably has a base portion 28, sidewall segments 30 for contacting the edges 22, and angled segments 32 connecting each sidewall segment 30 with the base portion 28 and extends the length of the panel member. The member 26 is further characterized by arcuate edge portions 34, preferably having a substantially semi-cylindrical configuration, which further define a hollow interior portion 36. The purpose of the edge portions 34 and hollow portion 36 will be described in more detail hereinafter. In a preferred embodiment, the member 26 is a stainless steel spring which has been roll formed at the top to form edge portions 34.

The member 26 is held in position by suitable fastening means such as screws 38. If desired, the screws 38 may be used to connect channel 12 as well as member 26 to a supporting structure 40 of the building. A backing plate 42 having a desired thickness may be provided to act as a dimensional adjustment spacer and an electrical insulator between the dissimilar materials forming the member 26 and the supporting structure 40. To attach the member 26 and the channel 12 to the supporting structure 40 and/or plate 42, each screw 38 is first inserted through a hole in the base portion 28 of member 26, then through a hole in base portion 13 of channel 12, and finally through matching holes in backing plate 42, if present, and support structure 40.

A resilient elastomeric member 44 is provided to seal the gap between the adjacent panel members and thereby eliminate the need for sealant such as silicone sealants. While the member 44 may have any desired shape, it is preferred that it have an arrowhead shaped profile. The use of an arrowhead or similarly shaped profile allows the member 444 to be is held in a desired position relative to the panel members by the insertion of a first end 46 into the hollow interior portion 36 and by the engagement of end portions 34 with a pair of locking surfaces 48 on the member 44. The elastomeric member 44 may be formed from any suitable material known in the art. For example, it may be an extruded rubber gasket.

To insure a complete sealing of the gap between adjacent panel members, a dry sealant tape 50 may be installed into the bottom of channel 12. Preferably, the tape 50 is installed in the bottom of the channel before assembly into the finished attachment system.

As can be seen from the foregoing discussion, a panel joining apparatus has been provided which does not utilize external wet sealants such as silicone sealants which when exposed to atmospheric conditions collect dirt and allow it to spread across the faces of adjoining panel members rendering them aesthetically unappealing. The apparatus also accommodates thermal expansion and/or contraction of the panel member.

It is apparent that there has been provided in accordance with this invention an apparatus for joining wall panels which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for joining panel members together which comprises a substantially U-shaped channel for receiving a turned down edge portion of each of two side by side, spaced apart panel members, said channel having a base portion and two sidewalls, each sidewall having a locking member adapted to engage a mating portion of one of said edge portions for locking said panel members in position, resilient means for retaining said locking members and mating portions in an interlocking relationship, means for sealing the space between said panel members comprising a profiled elastomeric member having a pair of locking surfaces, and said resilient means having means for receiving and engaging a portion of said sealing means and thereby holding said sealing means in position, said receiving and engaging means comprising a hollow interior portion of said resilient means into which a part of said elastomeric member is inserted and edge portions for engaging said locking surfaces of said profiled member.

2. An apparatus as in claim 1 wherein said resilient means comprises a spring having a base segment, sidewall segments for contacting and pressing against said turned down edge portions and arcuate edge portions, and said segments and said edge portions define said hollow interior portion.

3. An apparatus as in claim 2 wherein said spring further has angled segments joining said base segment to said sidewall segments.

4. An apparatus as in claim 3 wherein said arcuate edge portions have a substantially semi-cylindrical configuration.

5. An apparatus as in claim 1 wherein said profiled member has an arrowhead-like shape.

6. An apparatus as in claim 1 wherein said resilient means is formed by a stainless steel spring, said channel is formed from aluminum or an aluminum alloy, and said profiled member is formed by an extruded rubber material.

7. An apparatus as in claim 1 which further comprises a dry sealant tape positioned adjacent the base portion of said channel.

8. An apparatus as in claim 1 which further comprises means for supporting said channel and means for fastening said channel and said resilient means to said support means.

9. An apparatus as in claim 8 wherein said fastening means comprises a threaded screw which passes through said resilient means, said channel and at least into said support means.

10. An apparatus for joining panel members together which comprises a channel having a base portion and two sidewalls for receiving edge portions of two spaced apart panel members, each said sidewall having a substantially semi-cylindrical portion for engaging a substantially semi-cylindrical mating portion on an edge of a respective one of said panel members, said semi-cylindrical portions locking said panel members into position relative to said channel, resilient means for maintaining said semi-cylindrical portions in engagement with each other and for allowing pivotal movement of said edges of said panel members positioned within said channel about said interlocked semi-cylindrical portions and thereby permitting thermal expansion of said panels, and said resilient means being positioned within said channel between the edges of said panel members.

11. An apparatus as in claim 10 further comprising means for sealing the space between said panel members and means for joining said sealing means to said resilient means.

12. An apparatus as in claim 11 wherein said joining means comprises a shaped portion of said sealing means adapted to be received within said resilient means and locking surfaces adapted to be engaged by a portion of said resilient means.

13. An apparatus as in claim 12 wherein said resilient means comprises a spring having edge portions adapted to engage said locking surfaces.

14. An apparatus as in claim 13 wherein said shaped portion has the configuration of an arrowhead.

* * * * *